US011358200B2

(12) United States Patent
Kim

(10) Patent No.: US 11,358,200 B2
(45) Date of Patent: Jun. 14, 2022

(54) ROLL STAMPING APPARATUS AND METHOD

(71) Applicant: POSCO, Pohang-Si (KR)

(72) Inventor: Don-Gun Kim, Incheon (KR)

(73) Assignee: POSCO, Pohang-si (KR)

( * ) Notice: Subject to any disclaimer, the term of this patent is extended or adjusted under 35 U.S.C. 154(b) by 360 days.

(21) Appl. No.: 16/065,748

(22) PCT Filed: Dec. 21, 2016

(86) PCT No.: PCT/KR2016/015055
§ 371 (c)(1),
(2) Date: Jun. 22, 2018

(87) PCT Pub. No.: WO2017/111478
PCT Pub. Date: Jun. 29, 2017

(65) Prior Publication Data

US 2019/0009319 A1 Jan. 10, 2019

(30) Foreign Application Priority Data

Dec. 23, 2015 (KR) ..... 10-2015-0185116

(51) Int. Cl.
*B21D 5/08* (2006.01)
*B21D 5/14* (2006.01)
(Continued)

(52) U.S. Cl.
CPC ..... *B21D 5/14* (2013.01); *B21D 5/083* (2013.01); *B21D 22/02* (2013.01); *B21D 11/20* (2013.01); *B21D 53/88* (2013.01)

(58) Field of Classification Search
CPC . B21D 22/02; B21D 5/06; B21D 5/08; B21D 5/083; B21D 5/14; B21D 5/146;
(Continued)

(56) References Cited

U.S. PATENT DOCUMENTS 3,690,137 A * 9/1972 Cookson ..... B21D 5/08 72/180
4,006,617 A * 2/1977 Foster ..... B21D 5/083 72/10.1
(Continued)

FOREIGN PATENT DOCUMENTS

CN 104487184 A 4/2015
CN 104624744 A 5/2015
(Continued)

OTHER PUBLICATIONS

Chinese Office Action dated Apr. 28, 2019 issued in Chinese Patent Application No. 201680075672.6 (with English translation).
(Continued)

*Primary Examiner* — Debra M Sullivan
(74) *Attorney, Agent, or Firm* — Morgan, Lewis & Bockius LLP

(57) ABSTRACT

A roll stamping apparatus includes sets of rollers that rotate while facing each other so as to press opposite surfaces of a material which is continuously supplied to move between the rollers. The sets of rollers have molding portions with a stamping structure applied to outer surfaces so as to mold the material, wherein a plurality of sets of rollers are disposed along a movement direction of the material, the respective molding portions of the sets of rollers are formed to sequentially change a cross section of the material along the movement of the material, and the molding portion of at least one set of rollers before a final set of rollers through which the material finally passes is a set of over-molding rollers having a length in a circumferential direction longer than the molding portions of the final set of rollers.

8 Claims, 9 Drawing Sheets

(51) Int. Cl.
*B21D 22/02* (2006.01)
*B21D 53/88* (2006.01)
*B21D 11/20* (2006.01)

(58) Field of Classification Search
CPC ..... B21D 7/08; B21D 39/023; B21D 13/04; B21D 13/045; B21J 9/025
See application file for complete search history.

(56) References Cited

U.S. PATENT DOCUMENTS

| | | | | |
|---|---|---|---|---|
| 8,573,012 | B1 * | 11/2013 | Paulson | B21D 13/04 72/8.3 |
| 2009/0205387 | A1 * | 8/2009 | Durney | B21D 11/08 72/178 |
| 2011/0003113 | A1 | 1/2011 | Lengauer et al. | |
| 2011/0172803 | A1 | 7/2011 | Suzuki et al. | |
| 2013/0104618 | A1 | 5/2013 | Daimaru | |
| 2015/0251234 | A1 | 9/2015 | Daimaru et al. | |
| 2016/0325330 | A1 | 11/2016 | Nitta et al. | |

FOREIGN PATENT DOCUMENTS

| | | | |
|---|---|---|---|
| JP | S17-4521 | B | 9/1942 |
| JP | S35-4800 | | 5/1960 |
| JP | 2000-225421 | A | 8/2000 |
| JP | 3302308 | B2 | 7/2002 |
| JP | 4107485 | B2 | 6/2008 |
| JP | 2009-148820 | A | 7/2009 |
| JP | 4419716 | B2 | 2/2010 |
| JP | 1964988 | B2 | 7/2012 |
| JP | 5728334 | B2 | 6/2015 |
| JP | 2015-174124 | A | 10/2015 |
| KR | 10-1232457 | B1 | 2/2013 |
| KR | 10-2013-0027521 | A | 3/2013 |
| KR | 10-2013-0131872 | A | 12/2013 |
| KR | 10-2014-0081620 | A | 7/2014 |
| KR | 10-1439674 | 81 | 9/2014 |
| WO | 2015/133464 | A1 | 9/2015 |

OTHER PUBLICATIONS

Japanese Office Action dated Jun. 25, 2019 issued in Japanese Patent Application No. 2018-532633.
Extended European Search Report dated Jan. 4, 2019 issued in European Patent Application No. 16879345.3.
Search Report issued in corresponding International Patent Application No. PCT/KR2016/015055, dated Mar. 14, 2017.

* cited by examiner (a) (b)

(a)

(b)

ROLL STAMPING APPARATUS AND METHOD

CROSS REFERENCE

This application is the U.S. National Phase under 35 U.S.C. § 371 of International Application No. PCT/KR2016/015055, filed on Dec. 21, 2016, which claims the benefit of Korean Application No. 10-2015-0185116, filed on Dec. 23, 2015, the entire contents of each are hereby incorporated by reference.

TECHNICAL FIELD

The present disclosure relates to a roll stamping apparatus including a rotating roll having a molding portion by which a stamped structure is applied to an outer surface, and a roll stamping method.

BACKGROUND ART

In general, numerous sheet metal molding technologies have been developed to produce parts applied to an automobile, or the like.

First, a stamping method is most widely used, and such a stamping method includes an upper die, a lower punch disposed below the upper die, and a material holder disposed between the upper die and the lower punch. Here, the upper die is a mold member having a groove portion formed in a lower surface thereof, wherein the groove portion is fitted to a shape of an article to be molded, and the lower punch is a member disposed below the upper die and is driven upwardly to thereby upwardly push a material moving between the upper die and the lower punch to press the material onto the upper die.

Such a stamping method is a technology which is widely used to produce the molded articles, for example, parts of the automobile, but in recent years, there are a problem in which capacity of the apparatus should be increased in an application of high-strength steel, and a problem in that the material is broken due to vulnerable moldability of the high strength steel.

Next, a roll forming (RF) method is used. The roll forming method is configured so that a set of multistage fixed upper and lower rotating rolls is arranged and a coil or a cut material passes therebetween, and molds a molded article, a part having a long length while having a constant cross-section shape.

The roll forming method by the rolling forming apparatus as described above may be applied to the high strength steel by utilizing an apparatus having relatively small capacity, but has a limitation in that only a molded article having the constant cross-section shape may be produced.

Accordingly, a roll stamping method as disclosed in Patent Document 1 has been developed. In the roll stamping method, since a stamped structure is applied to a rotating roll which is rotated, the roll stamping method is a method of performing variable cross section roll forming while the material passes through the rotating roll.

However, in the roll stamping method as described above, there is a problem in that an undesirable shape, such as a distortion or the like, due to residual stress of a cross section changing portion and unbalance of force between the respective cross section changing portions within a part, may occur.

(Patent Document 1) KR1417278 B

DISCLOSURE

Technical Problem

An aspect of the present disclosure is to provide a roll stamping apparatus and method that do not have an undesirable shape by solving residual stress of a cross section changing portion and unbalance of force between the cross section changing portions.

Technical Solution

The present disclosure provides a roll stamping method and apparatus to achieve the above-mentioned object.

According to an aspect of the present disclosure, a roll stamping apparatus includes sets of rollers rotating while facing each other so as to press opposite surfaces of a material which is continuously supplied to move between the rollers; and molding portions having a stamping structure applied to outer surfaces of the sets of rollers so as to mold the material, wherein a plurality of sets of rollers are disposed in a movement direction of the material, the respective molding portions of the sets of rollers are formed to sequentially change a cross section of the material in the movement direction of the material, and the molding portion of at least one set of rollers of the sets of rollers before a final set of rollers through which the material finally passes is a set of over-molding rollers having a length in a circumferential direction longer than the molding portions of the final set of rollers.

The set of over-molding rollers may be disposed within at least three sets of rollers of the final set of rollers.

The molding portion may include an intaglio formed in an outer surface of a rotation roll of one roller of the set of rollers and having both sides opened, and an embossment formed in an outer surface of a rotation roll of the other roller thereof and corresponding to the intaglio.

The molding portions of the sets of rollers may perform planarization for a cross section of the material by sequentially forming a concave-convex portion on the cross section of the material or removing the concave-convex portion from the cross section of the material in the movement direction of the material.

The molding portions of the sets of rollers may perform planarization for a cross section of the material by sequentially removing a concave-convex portion from the cross section of the material, the molding portions of the final set of rollers and the set of over-molding rollers may include flat portions which are flat in a width direction and have a predetermined length in a circumferential direction, and transition portions positioned at both sides of the flat portion in the circumferential direction, and a length of the flat portion of the set of over-molding rollers in the circumferential direction may be longer than a length of the flat portion of the final set of rollers in the circumferential direction.

Escape portions through which the material passes may be formed in the positions different from the molding portions in the outer surfaces of the sets of rollers.

The escape portions may be formed in opposite sides of the molding portions and may be concave in an inner diameter direction from outer circumferential surfaces of the rollers.

According to another aspect of the present disclosure, a roll stamping method includes a plurality of molding steps of molding a material which is continuously supplied, through stamping structures formed on outer surfaces of sets of rollers; and a cutting step of cutting the molded material, wherein the material passes through the plurality of molding steps such that a portion thereof is changed from a first shape to a second shape, and the plurality of molding steps include a reverse deformation molding step, opposite to a deformed direction in which the material is deformed from the first shape to the second shape.

In the reverse deformation molding step, both end portions of a molded portion of the material in a length direction may be reversely deformed.

The reverse deformation molding step may be performed in the final molding steps.

The both end portions may be reversely deformed in the reverse deformation molding step by molding a molding portion of the material to be longer than a target molding portion, before the reverse deformation molding step.

The roll stamping method may further include, after the plurality of molding steps, bypassing the material to escape portions formed in the sets of rollers, wherein after the bypassing of the material, the plurality of molding steps may be reperformed, and a ratio of a supply speed of the material to revolutions per minute of the sets of rollers in the plurality of molding steps may be different from that in the bypassing of the material.

Advantageous Effects

As set forth above, according to an exemplary embodiment in the present disclosure, the roll stamping apparatus and method may reduce the undesirable shape by solving the residual stress of the cross section changing portion and the unbalance of force between the cross section changing portions.

BEST MODE FOR INVENTION

Hereinafter, exemplary embodiments in the present disclosure will be described with reference to the accompanying drawings.

Figure 1:
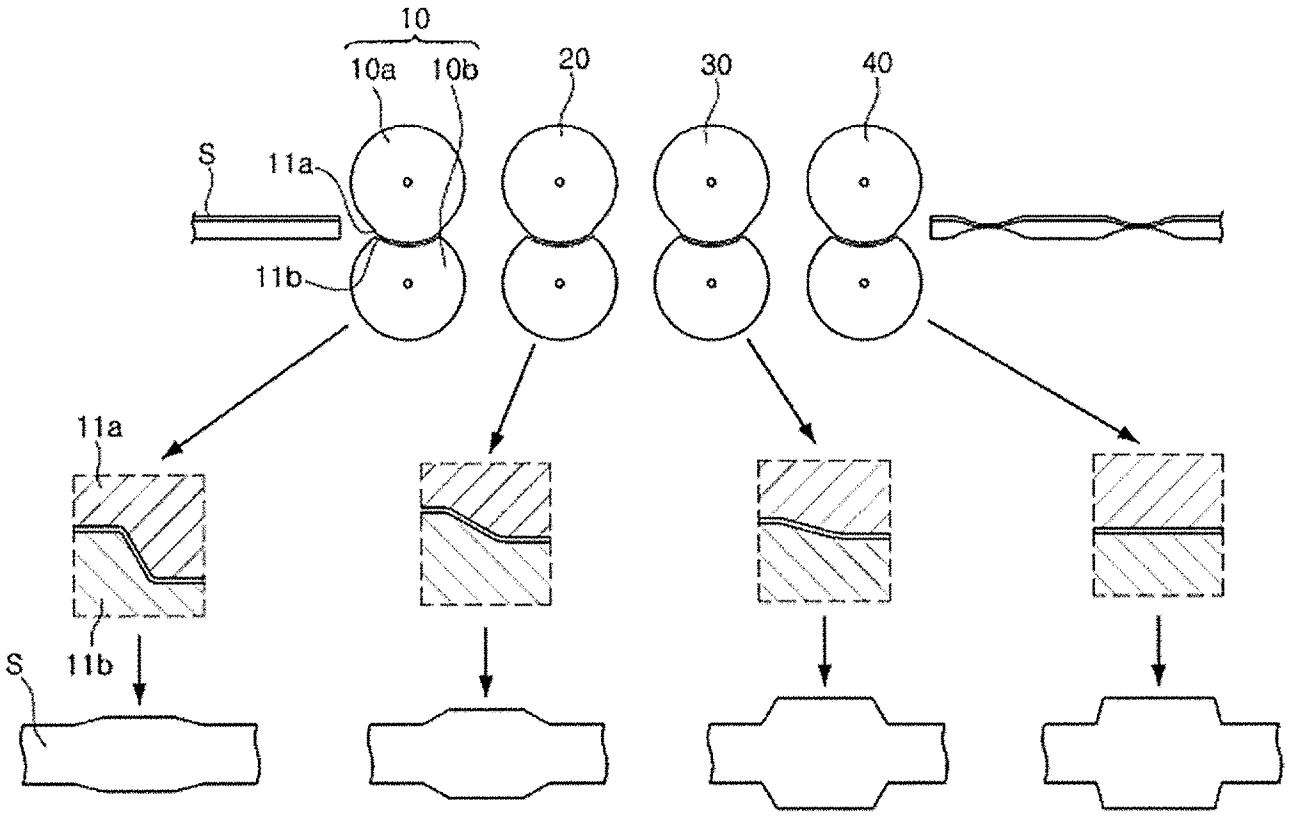
FIG. 1 PRIOR ART
FIG. 1 is a view illustrating a conventional roll stamping apparatus.
Figure 2:
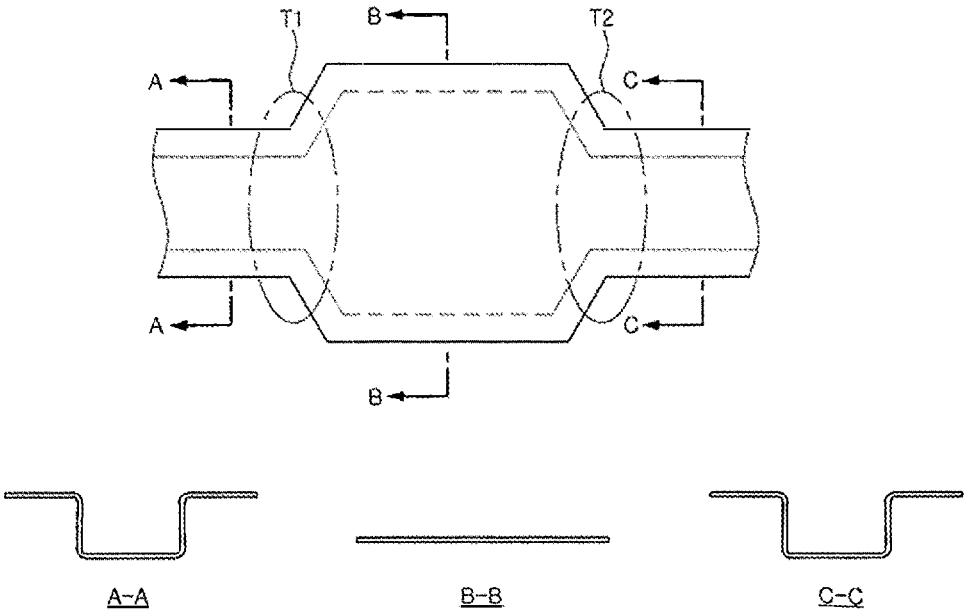
FIG. 2 PRIOR ART
FIG. 2 is a plan view of a product manufactured by the conventional roll stamping apparatus.

FIGS. 1 and 2 illustrate the conventional roll stamping apparatus and a product molded by the conventional roll stamping apparatus. As illustrated in FIG. 1, in the conventional roll stamping apparatus, a plurality of roller sets 10, 20, 30, and 40 are disposed in a movement direction of a material, each of the roller sets 10, 20, 30, and 40 includes an upper roll 10*a* and a lower roll 10*b*, and molding portions 11*a* and 11*b* are formed in each of the rolls 10*a* and 10*b* to mold the material.

Each of the roller sets 10, 20, 30, and 40 includes the molding portion, and sequentially changes the molding portion along the movement direction of the material as illustrated in FIG. 1 to mold a portion of the material from a first shape before molding to a second shape different from the first shape.

The product molded by the roll stamping apparatus described above may include transition portions T1 and T2 which are changed to portions (cross sections A-A and C-C) having a first shape and a portion (a cross section B-B) molded by the molding portion and having a second shape. The above-mentioned transition portions T1 and T2 may have residual stress that exists in directions opposite to each other, and have a problem in that the transition portions are distorted when being cut into the product or before being cut into the product.

Figure 3:
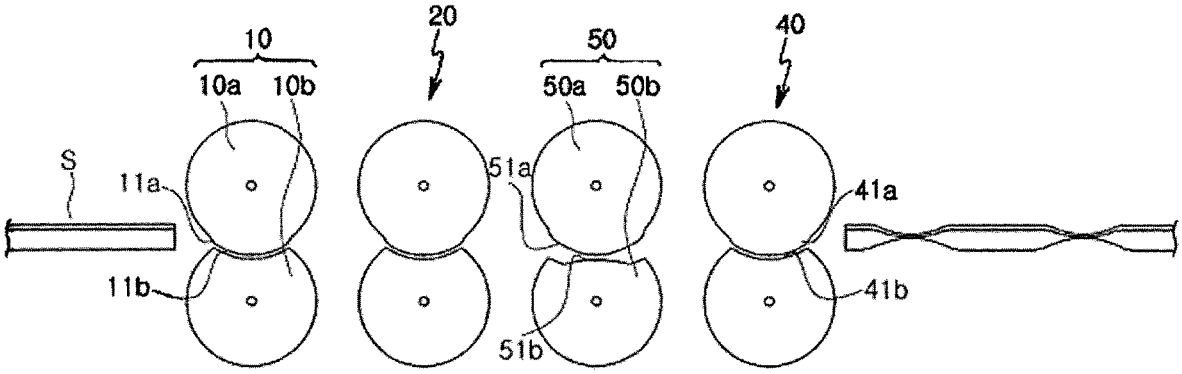
FIG. 3 is a view illustrating a roll stamping apparatus according to the present disclosure.

An object of the present disclosure is to reduce the undesirable shape of the product by removing the residual stress remaining in the transition portions or at least preventing the transition portions from being distorted, and FIG. 3 illustrating a roll stamping apparatus according to the present disclosure for achieving the above-mentioned object.

As illustrated in FIG. 3, the roll stamping apparatus according to the present disclosure may include sets of rollers 10, 20, 40, and 50 rotating while facing each other so as to press opposite surfaces of a material S, continuously supplied to move between the rollers, and molding portions 11*a*, 11*b*, 41*a*, 41*b*, 51*a*, and 51*b* having a stamping structure applied to outer surfaces of the sets of rollers 10, 20, 40, and 50 so as to mold the material, wherein a plurality of sets of rollers 10, 20, 40, and 50 are disposed in a movement direction of the material, the respective molding portions of the sets of rollers are formed to sequentially change a cross section of the material in the movement direction of the material, and the molding portions 51*a* and 51*b* of at least one set of rollers of the sets of rollers before a final set of rollers through which the material finally passes is a set of over-molding rollers 40 having a length in a circumferential direction longer than the molding portions 41*a* and 41*b* of the final set of rollers 40.

FIGS. 4A through 4D are plan views for each of the steps of a material molded by the roll stamping apparatus of FIG. 3, wherein FIG. 4A is a plan view of the material molded by the set of rollers 10 of FIG. 3, FIG. 4B is a plan view of the material molded by the set of rollers 20 of FIG. 3, FIG. 4C is a plan view of the material molded by the over-molding set of rollers 50 of FIG. 3, and FIG. 4D is a plan view of the material molded by the final set of rollers 40 of FIG. 3.

As illustrated in FIGS. 4A through 4D, as the material S passes through the sets of rollers 10, 20, 40, and 50, the cross section of the material may be sequentially changed from a hat shape (a first shape) to a flat shape (a second shape) by the molding portions.

Here, the shape of the material or the number of the sets of rollers is merely an example, the number of the sets of rollers may be increased or decreased as needed, and the material may have a shape corresponding to a desired product. In addition, although FIGS. 4A through 4D illustrate a case in which the material has the same width before being molded, the width of the material may also be cut before the material is roll-stamped.

FIG. 4A is a plan view of the material passing through a first set of rollers 10, wherein some regions 101, 102, and 103 of the material which had the hat-shaped cross section are molded. Transition portions 102 and 103 may be formed between an unmolded region and a flat portion 101 with respect to the flat portion 101 having a flat outer surface on the plan view among the molded regions. The flat portion 101 of FIG. 4A refers to a region having the same cross section in the movement direction of the material regardless the flat cross section thereof, and the transition portions 102 and 103 refer to regions in which a cross section is changed along the movement direction of the material.

FIG. 4B is a plan view of the material passing through a second set of rollers 20, wherein some regions 101, 102, and 103 of the material which had the hat-shaped cross section are molded more than those molded by the first set of rollers 10 (see FIG. 1). However, the second set of rollers 20 and the first set of rollers 10 perform the molding for the regions having the same length (L1=L2).

FIG. 4C is a plan view of the material passing through the over-molding set of rollers 50. Some regions 101, 102, and 103 of the material are molded more than those molded by the second set of rollers, and the length of the molded region is longer than that molded by the second set of rollers (L1=L2<L3). Since the molded region of the material passing through the over-molding set of rollers 50 is longer than that of the material passing through the second set of rollers 20, lengths of the molding portions 51*a* and 51*b* of the over-molding set of rollers 50 in a circumferential direction may be longer than lengths of the molding portions 11*a* and 11*b* of the first and second sets of rollers 10 and 20 in the circumferential direction.

FIG. 4D is a plan view of the material passing through the over-molding set of rollers 50 and then passing through the final set of rollers 40 to have a desired second shape. As illustrated in FIG. 4D, since the final set of rollers 40 molds the over-molded material to a target shape by again reversely molding the over-molded material, a length L4 of a material molding region may be smaller than a length L3 of a material molding region passing through the over-molding set of rollers (L3≥L4). Accordingly, the transition portions 102 and 103 in which the cross section of the material is changed from the first shape to the second shape and the return portions 105 and 106 which are the transition portions in the previous set of rollers and returned to the first shape of FIG. 4D may be molded in a reverse direction of the direction in which the material is deformed from the first shape to the second shape (a hatched portion of FIG. 4D).

Accordingly, since the transition portions 102 and 103 and the return portions 105 and 106 of the material are molded from the first shape to the second shape and are thus molded in a reverse direction of a direction of the formed residual stress, the residual stress of the final product may be reduced.

In FIGS. 4A through 4D, although it is illustrated and described that one set of over-molding rollers 50 is disposed immediately before the final set of rollers 40, the set of over-molding rollers 50 is not limited thereto and a plurality of sets of rollers before the final set of rollers 40 may be formed as the sets of over-molding rollers 50.

In addition, the set of over-molding rollers 50 may include a case in which the length in the length direction of the material, that is, the length in the circumferential direction of the roll is longer than the lengths of the molding portions of the final set of rollers in the circumferential direction, and may also include a case in which since a degree of the material molded by the set of over-molding rollers is greater than that molded by the molding portions of the final set of rollers, the material is changed in a reverse direction to become the second shape, the target shape (the material does not change from the first shape to the second shape but changes to a third shape that is a shape beyond the second shape and then to the second shape) again.

The roll stamping apparatus according to the present disclosure may also be applied to a roll stamping method corresponding thereto. Since the distortion of the material becomes more problematic when the material is cut, the roll stamping method according to the present disclosure may include a plurality of molding steps of molding a material which is continuously supplied, through stamping structures formed on outer surfaces of the sets of rollers 10, 20, 40, and 50, and a cutting step of cutting the molded material, wherein the material passes through the plurality of molding steps such that a portion thereof is changed from a first shape to a second shape, and the plurality of molding steps include a reverse deformation molding step (the material passes through the set of over-molding rollers 50 and then passes through the final set of rollers 40), which is opposite to a deformed direction in which the material is deformed from the first shape to the second shape.

In this case, if the material is again molded in the molding direction in which the material is molded from the first shape to the second shape after the reverse deformation molding step, since the residual stress is increased in the directions opposite to each other in the transition portions 102 and 103 as in the related art and the distortion of the material may occur, the reverse deformation molding step may be performed at least after the middle of an entire molding step so that the molding in which the residual stress is again increased after the reverse deformation molding is small.

In addition, the residual stress of the transition portions 102 and 103 may also be reduced by increasing or decreasing the length of the molding portion, but the residual stress may also be reduced by changing the shape of the molding portion. For example, the residual stress of the transition portions 102 and 103 may also be reduced by performing a reverse direction bending in the transition portions 102 and 103 in the final molding step.

Figure 5:
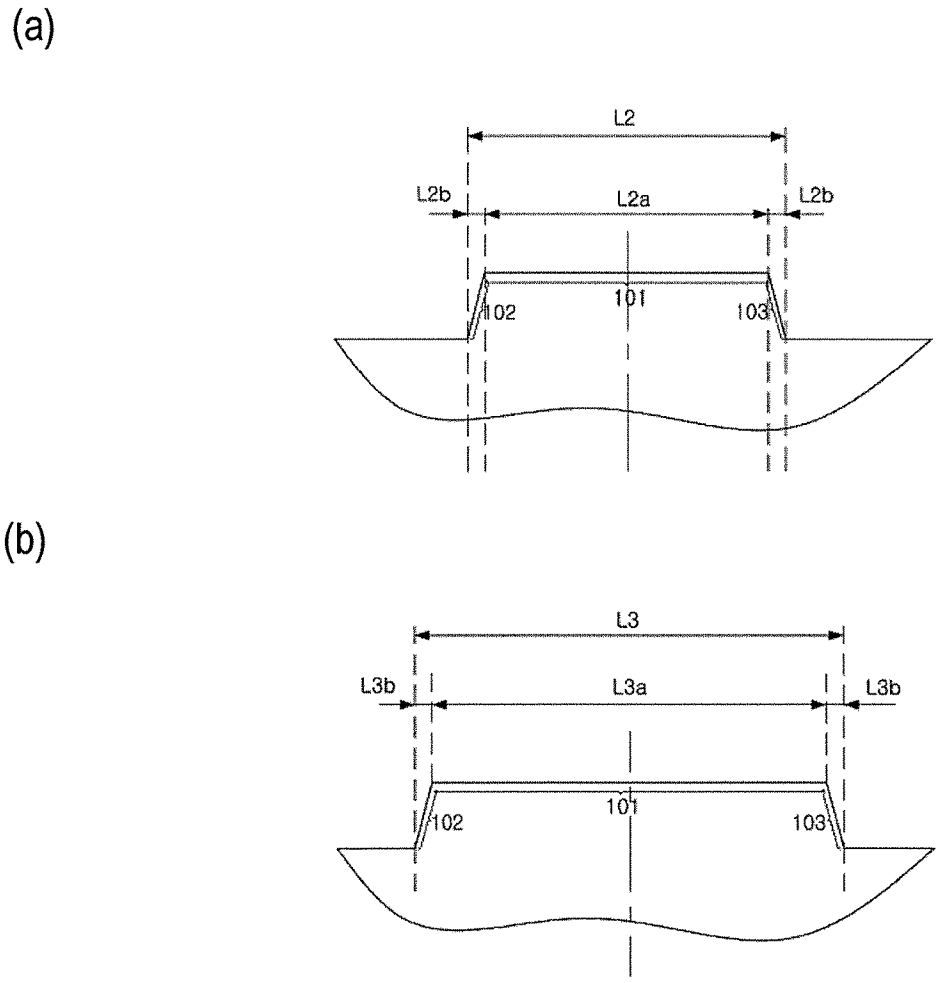
FIGS. 5A and 5B are plan views illustrating a final shape of the product manufactured by the roll stamping apparatus and a shape of a product molded in an over-molding roller set according to the present disclosure.
Figure 6:
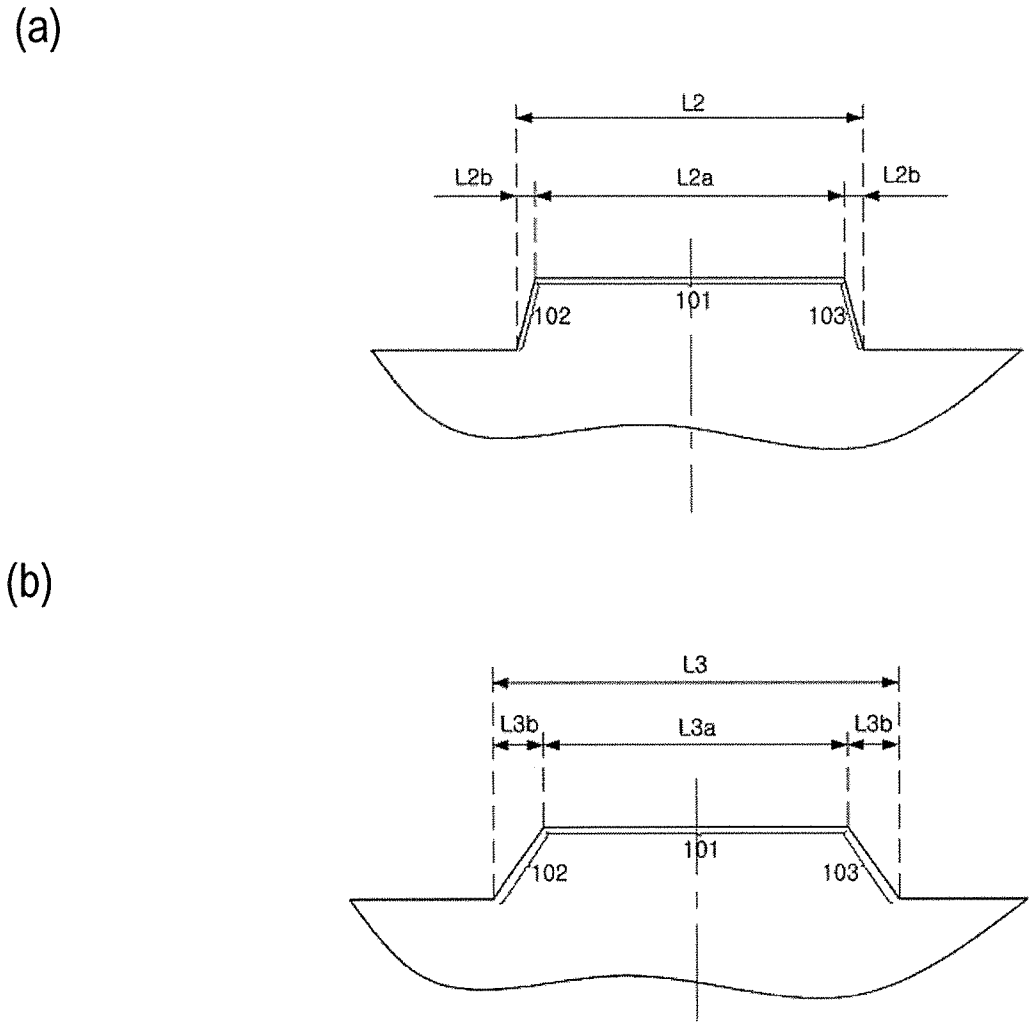
FIGS. 6A and 6B are plan views illustrating a final shape of the product manufactured by the roll stamping apparatus and a shape of another product molded in an over-molding roller set according to the present disclosure.

FIGS. 5 and 6 illustrate plan views showing a final shape of a product manufactured by the roll stamping apparatus and a shape of a material molded by the set of over-molding rollers according to the present disclosure, respectively.

In both FIGS. 5 and 6, a length L2 of a region molded by the second set of rollers may be shorter than a length L3 of a region molded by the set of over-molding rollers (L2<L3).

In FIG. 5, lengths L2*b* and L3*b* of the transition portions 102 and 103 may be equal to each other after the transition portions pass through the second set of rollers and after the transition portions pass through the set of over-molding rollers (L2*b*=L3*b*), but with respect to lengths L2*a* and L3*a* of the flat portion 101, the length of the flat portion 101 of the set of over-molding rollers may be longer than the length of the flat portion of the second set of rollers by an increased length of the molded region (L3*a*>L2*a*). That is, the set of over-molding rollers may mold the material in a way in which an entire length of the molded region is increased by increasing the length of the flat portion 101 without changing the shape of the transition portions 102 and 103, and the over-molded material as described above may be returned to a target molding length L4 in the final set of rollers 40 and the transition portions 102 and 103 may be again moved. During this process, a reverse molding may occur.

In FIG. 6, lengths L3*a* and L2*a* of the flat portion 101 may be equal to each other after the flat portion passes through the second set of rollers and after the flat portion passes through the set of over-molding rollers (L2*a*=L3*a*), but with respect to lengths L2*b* and L3*b* of the transition portions 102 and 103, a summation of the lengths of the transition portions 102 and 103 of the set of over-molding rollers may be longer than a summation of the lengths of transition portions of the second set of rollers by an increased length of the molded region (ΣL3*a*>ΣL2*a*).

Figure 4:
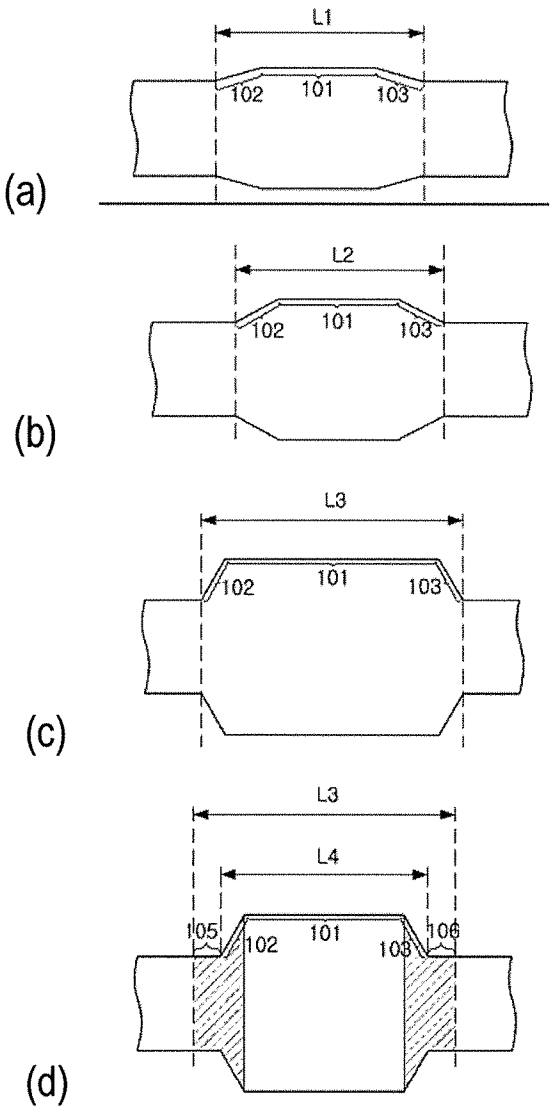
FIGS. 4A through 4D are plan views for each of the steps of a product manufactured by the roll stamping apparatus according to the present disclosure.

The set of over-molding rollers may mold the material in a way in which an entire length of the molded region is increased by increasing the lengths of the transition portions 102 and 103 without changing the shape of the flat portion 101, and the over-molded material as described above may be returned to a target molding length L4 in the final set of rollers 40 and some of the transition portions 102 and 103 may become the return portions 105 and 106 (see FIG. 4). During this process, a reverse molding may occur.

Figure 7:
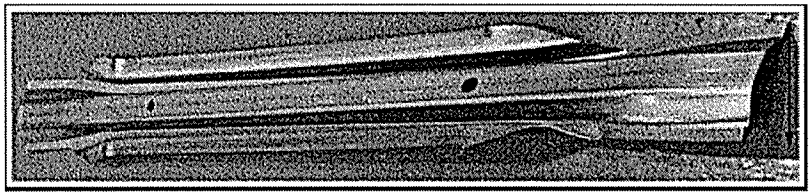
FIGS. 7A and 7B are photographs of a product molded by the conventional roll stamping apparatus and a product molded by the roll stamping apparatus according to the present disclosure.
Figure 7:
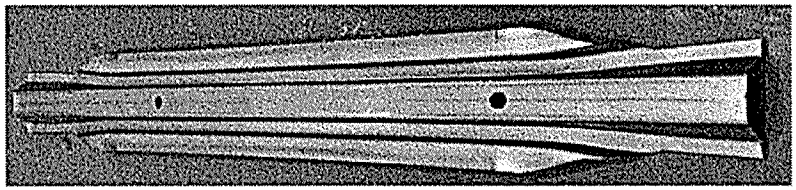

FIG. 7A illustrates a photograph of a material molded by the conventional roll stamping apparatus. As illustrated in FIG. 7A, the material is not attached to a bottom and is distorted. That is, in a case in which the material is molded by the conventional roll stamping apparatus, the distortion has occurred in the material due to residual stress in directions opposite to each other in a plurality of transition portions.

FIG. 7B illustrates a photograph of a material molded by the roll stamping apparatus according the present disclosure. As illustrated in FIG. 7B, in a case in which the material is molded by the roll stamping apparatus according to the present disclosure, it may be seen that the material is attached to the bottom without being distorted.

Figure 8:
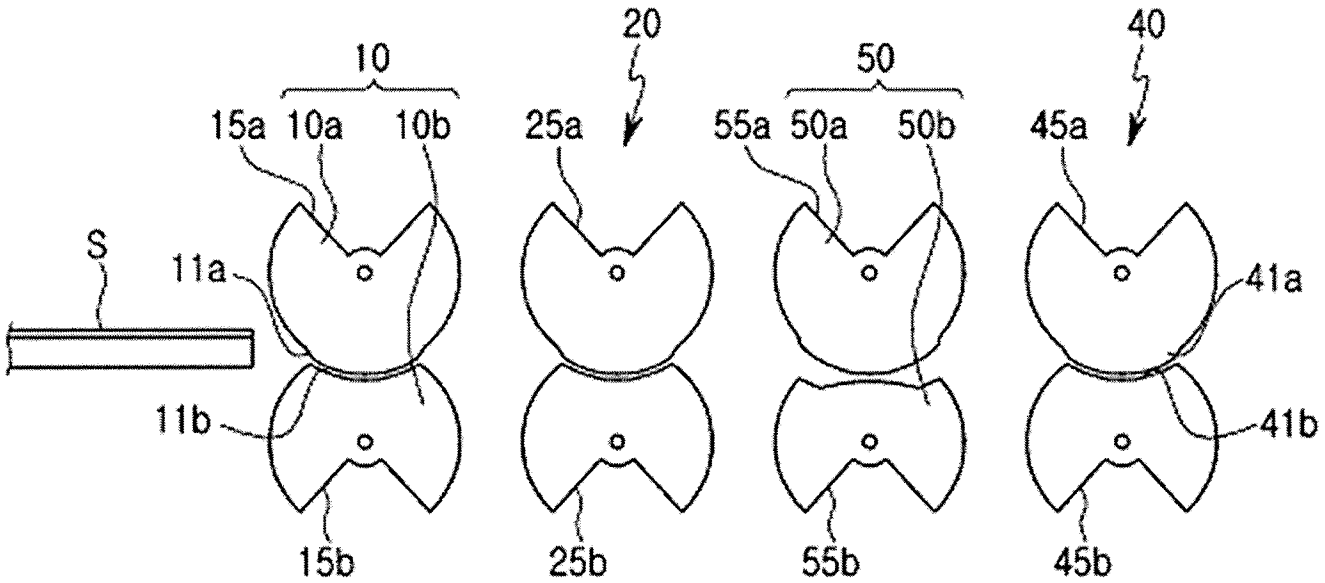
FIGS. 8 and 9 are views illustrating a roll stamping apparatus according to another exemplary embodiment in the present disclosure.
Figure 9:
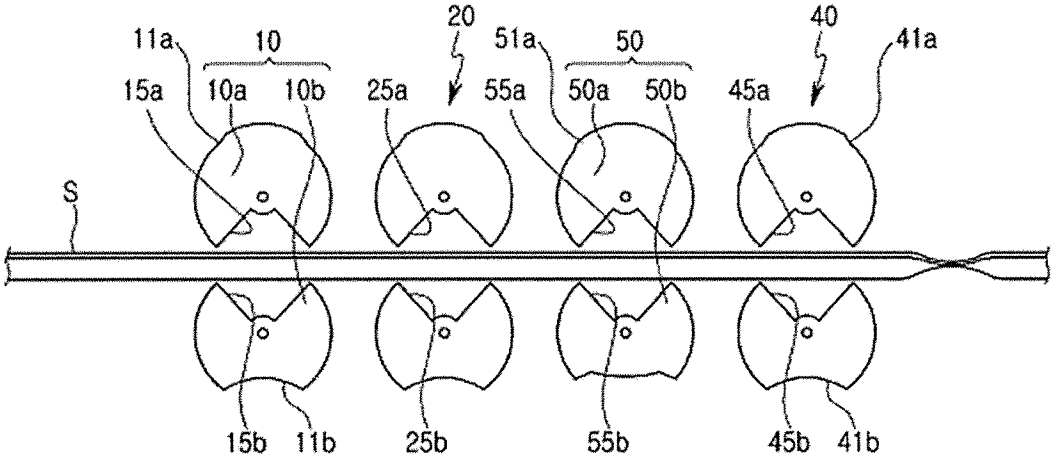

FIGS. 8 and 9 illustrate a roll stamping apparatus according to another exemplary embodiment in the present disclosure.

The roll stamping apparatus according to another exemplary embodiment illustrated in FIGS. 8 and 9 includes sets of rollers 10, 20, 40, and 50 having the same molding portions as the exemplary embodiment illustrated in FIG. 3, but there is a difference in that the sets of rollers 10, 20, 40, and 50 have escape portions 15*a*, 15*b*, 25*a*, 25*b*, 45*a*, 45*b*, 55*a*, and 55*b* formed on surfaces opposite to the respective molding portions.

According to the present exemplary embodiment, the escape portions 15*a*, 15*b*, 25*a*, 25*b*, 45*a*, 45*b*, 55*a*, and 55*b* are configurations formed to be concave inwardly from a circumference of the rolls, and are formed on the opposite sides of the molding portions 11*a*, 11*b*, 41*a*, 41*b*, 51*a*, and 51*b*.

As illustrated in FIG. 9, the escape portions 15*a*, 15*b*, 25*a*, 25*b*, 45*a*, 45*b*, 55*a*, and 55*b* of both rollers of the sets of rollers 10, 20, 40 and 50 may be disposed to face each other according to the rotation of the roll, and in this case, the material S passing through the sets of rollers 10, 20, 40, and 50 may pass therethrough without being molded. Since the escape portions 15*a*, 15*b*, 25*a*, 25*b*, 45*a*, 45*b*, 55*a*, and 55*b* are formed on predetermined regions in the outer periphery of the rollers, the molding may not be performed in predetermined sections in the rotation of the rollers.

According to the present exemplary embodiment, since the sets of rollers 10, 20, 40, and 50 have the escape portions 15*a*, 15*b*, 25*a*, 25*b*, 45*a*, 45*b*, 55*a*, and 55*b* formed together with the molding portions 11*a*, 11*b*, 41*a*, 41*b*, 51*a*, and 51*b*, the sets of rollers 10, 20, 40, and 50 may mold the material S in the predetermined sections and bypass the material S in the predetermined section.

In particular, since the sets of rollers 10, 20, 40, and 50 are not in contact with the material S when the escape portions 15*a*, 15*b*, 25*a*, 25*b*, 45*a*, 45*b*, 55*a*, and 55*b* face each other, the material S may be moved faster than when the material S is molded. Therefore, the material may be molded without changing the sets of rollers even in a case in which an interval between molded sections L4 and L6 (see FIG. 10) is changed.

Figure 10:
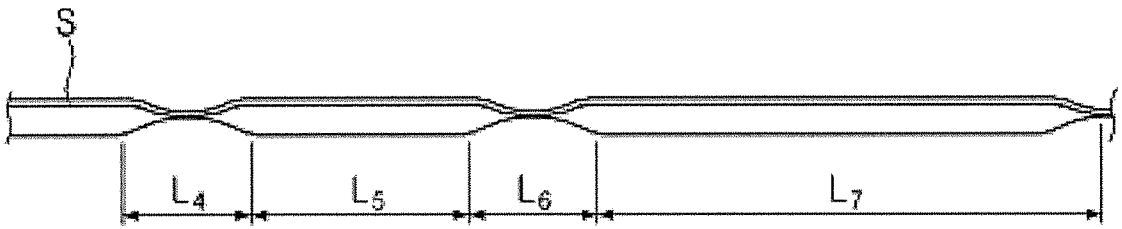
FIG. 10 is a side view of a product molded by the roll stamping apparatus of FIGS. 8 and 9.

FIG. 10 illustrates the material S molded according to the exemplary embodiment of FIGS. 8 and 9. In the molded sections L4 and L6, when a supply speed (m/min) of the material S is constant, revolutions per minute (rev/min) of the sets of rollers 10, 20, 40, and 50 may be maintained to be constant at the time of molding of the material, but when the material is not molded, in particular, when the escape portions 15*a*, 15*b*, 25*a*, 25*b*, 45*a*, 45*b*, 55*a*, and 55*b* face each other, lengths of unmolded sections L5 and L7 may be adjusted by adjusting the revolutions per minute of the sets of rollers 10, 20, 40, and 50 to be slow or fast. That is, a produce having a different entire length while having the same molding portion may be molded by making a ratio of the supply speed of the material to the revolutions per minute of the sets of rollers at the time of molding different from that at the time of un-molding.

Accordingly, a product in which a length of a roll forming portion according to the present exemplary embodiment is diverse may also be manufactured. In particular, in the case of a configuration such as a door impact beam in which the molded section is constant and a length thereof is diverse, one roll stamping apparatus may mold door impact beams having various different lengths.

Hereinabove, although the exemplary embodiments in the present disclosure have been described, the present disclosure is not limited thereto and may be variously changed and used.

The invention claimed is:

1. A roll stamping method for changing a material from a first shape into a second shape which is different from the first shape, comprising:

forming the material into the first shape that has a first molding portion length and first transition portions lengths on opposite ends of the first molding portion length in a longitudinal direction of the material by passing the material through a first set of rollers which face each other and have, on outer surfaces thereof, a first molding portion that includes first transition portions on opposite ends of the first molding portion in a circumferential direction of the first set of rollers; wherein the longitudinal direction of the material is defined by the circumferential direction of the first set of rollers; and changing the first shape into the second shape that has a second molding portion length and second transition portions lengths on opposite ends of the second molding portion length in the longitudinal direction by passing the material through a second set of rollers which face each other and have, on outer surfaces thereof, a second molding portion that includes second transition portions at opposite ends of the second molding portion in a circumferential direction of the second set of rollers which rotate in the circumferential direction of the first set of rollers;

wherein a sum of the first molding portion length and first transition portions lengths is larger than a sum of the second molding portion length and second transition portions lengths in the longitudinal direction.

2. The roll stamping method of claim 1, further comprising forming the material into a shape before forming the first shape.

3. The roll stamping method of claim 2, sequentially changing the shape to the first shape.

4. The roll stamping method of claim 1, wherein the first molding portion length of the first shape is greater than the second molding portion length of the second shape in the longitudinal direction.

5. The roll stamping method of claim 1, wherein the first transition portions lengths are the same as the second transition portions lengths in the longitudinal direction.

6. The roll stamping method of claim 1, wherein the first molding portion length of the first shape is the same as the second molding portion length of the second shape and the first transition portions lengths are greater than the second transition portions lengths in the longitudinal direction.

7. The roll stamping method of claim 1, wherein after changing the first shape into the second shape, the direction of residual stress in the second transition portions lengths and the direction of residual stress in the second molding portion length are formed to be different from each other.

8. The roll stamping method of claim 1, wherein, prior to the first shape, forming the material into a prior shape that has a prior molding portion length and prior transition portions lengths on opposite ends of the prior molding portion length in the longitudinal direction of the material by passing the material through a prior set of rollers which face each other and have, on outer surfaces thereof, a prior molding portion that includes prior transition portions on opposite ends of the prior molding portion in a circumferential direction of the prior set of rollers which rotate in the circumferential direction of the first set of rollers;

wherein a sum of the prior molding portion length and prior transition portions lengths is smaller than a sum of the first molding portion length and first transition portions lengths in the longitudinal direction.

* * * * *